US006319341B1

(12) United States Patent
Blomquist

(10) Patent No.: US 6,319,341 B1
(45) Date of Patent: Nov. 20, 2001

(54) PROCESS FOR PREPARING A GAS GENERATING COMPOSITION

(75) Inventor: Harold R. Blomquist, Gilgert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/578,658

(22) Filed: May 25, 2000

(51) Int. Cl.[7] ..... C06B 21/00
(52) U.S. Cl. ..... 149/19.92; 264/3.3; 264/3.4
(58) Field of Search ..... 149/19.92; 264/3.3, 264/3.4

(56) References Cited

U.S. PATENT DOCUMENTS 3,819,336 * 6/1974 Rogers et al. ..... 264/3.3
3,855,373 * 12/1974 Swotinski et al. ..... 149/100
3,984,264 * 10/1976 Lampert ..... 149/7
4,113,811 * 9/1978 Helfgen et al. ..... 149/19.92
4,421,578 * 12/1983 Voreck, Jr. ..... 149/2
4,469,647 * 9/1984 Speer ..... 264/3.3
4,477,297 * 10/1984 Chi ..... 149/19.92
4,923,535 * 5/1990 Waters et al. ..... 149/19.92
4,983,235 * 1/1991 Nyqvist et al. ..... 264/3.4
5,125,684 * 6/1992 Cartwright ..... 264/3.3
5,218,166 * 6/1993 Schumacher et al. ..... 149/19.92
5,437,229 * 8/1995 Taylor et al. ..... 264/3.4
5,531,845 7/1996 Flanigan et al. .
5,589,662 * 12/1996 Schleicher et al. ..... 264/3.4
5,731,540 3/1998 Flanigan et al. .
5,756,930 5/1998 Chan et al. .
5,759,458 * 6/1998 Haaland et al. ..... 264/3.3
5,993,578 * 11/1999 Timmerman ..... 149/19.92

* cited by examiner

*Primary Examiner*—Edward A. Miller
(74) *Attorney, Agent, or Firm*—Tarolli, Sundheim, Covell, Tummino & Szabo L.L.P.

(57) ABSTRACT

A process for preparing a gas generating composition (62) for a vehicle occupant protection apparatus (110) comprises the following steps. Desired quantities of ingredients of the gas generating composition (62) measured in predetermined amounts according to the percentage of the ingredients in the gas generating composition (62) are obtained. The ingredients include an elastomeric binder (16), an oxidizer (12), and a fuel (14). The ingredients are mixed with an azeotrope (28) to form a suspension. The suspension is atomized to form a stream (48) of spheroid droplets. The spheroid droplets are contacted with a hot gas to remove the azeotrope (28) from the spray droplets and produce solid spheroid particles of the gas generating composition (62) in which the oxidizer and fuel particles are intimately mixed with each other and bound together by the elastomeric binder.

26 Claims, 1 Drawing Sheet

PROCESS FOR PREPARING A GAS GENERATING COMPOSITION

FIELD OF THE INVENTION

The present invention relates to a process for preparing a gas generating composition. The gas generating composition is particularly useful for inflating a vehicle occupant protection device.

BACKGROUND OF THE INVENTION

An inflator for inflating an inflatable vehicle occupant protection device, such as an air bag, contains an ignitable gas generating composition. The inflator further includes an igniter. The igniter is actuated so as to ignite the gas generating composition when the vehicle experiences a collision for which inflation of the air bag is desired to help protect a vehicle occupant. As the gas generating composition burns, it generates a volume of inflation gas. The inflation gas is directed into the air bag to inflate the air bag. When the air bag is inflated, it expands into the vehicle occupant compartment and helps to protect the vehicle occupant.

SUMMARY OF THE INVENTION

The present invention is a process for preparing a gas generating composition. The gas generating composition is particularly useful for a vehicle occupant protection apparatus. The process comprises the following steps. Desired quantities of ingredients of the gas generating composition measured in predetermined amounts according to the percentages of the ingredients in the gas generating composition are obtained. The ingredients include an elastomeric binder, an oxidizer and a fuel. The ingredients are mixed with an azeotrope to form a suspension. The suspension is atomized to form a stream of spheroid droplets. The spheroid droplets are contacted with a hot gas to remove the azeotrope from the spray droplets and produce solid spheroid particles of the gas generating composition in which the oxidizer and fuel particles are intimately mixed with each other and bound together by the elastomeric binder.

BRIEF DESCRIPTION OF THE DRAWINGS

The foregoing and other features of the invention will become more apparent to one skilled in the art upon consideration of the following description of the invention and the accompanying drawings in which.

DESCRIPTION OF PREFERRED EMBODIMENTS

Figures 1, 2:
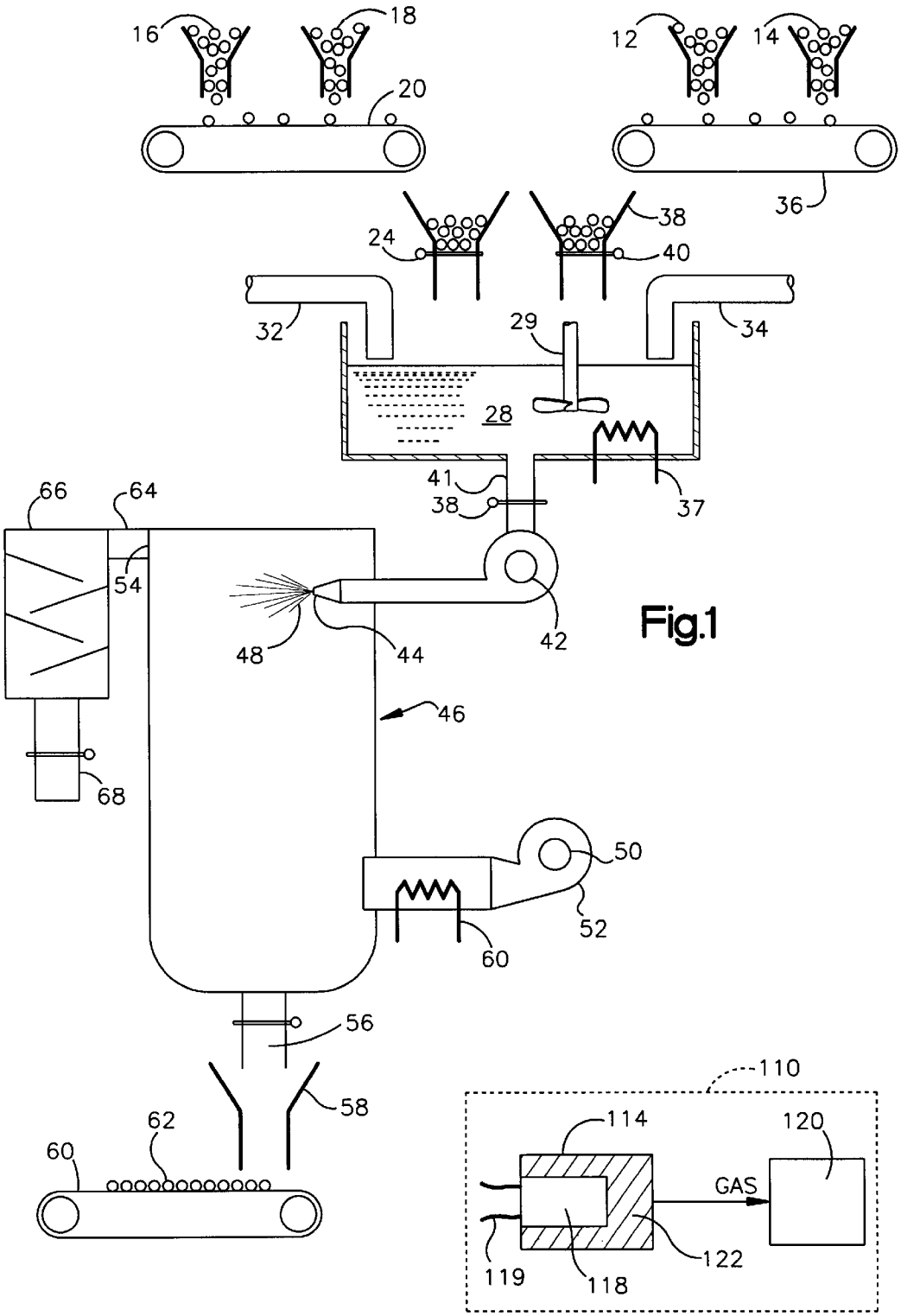
FIG. 1 is a schematic illustration of the process of the present invention.
FIG. 2 is a schematic illustration of an apparatus employing a gas generating composition prepared according to the process of the present invention.

A gas generating composition in accordance with the present invention comprises an intimate mixture of particles of an oxidizer and particles of a fuel agglomerated with an elastomeric binder.

The process for preparing the gas generating composition of the present invention is illustrated schematically in FIG. 1. Desired quantities of a particulate fuel 12, a particulate oxidizer 14, a particulate elastomeric binder 16, to bind the fuel and oxidizer particles, and a particulate dispersant 18 are obtained. Other ingredients, if used, (not shown) may also be obtained. The quantities of the particulate fuel 12, the particulate oxidizer 14, the elastomeric binder 16, the particulate dispersant 18, and other ingredients (if used) are measured in predetermined amounts as shown according to the percentages of the particulate fuel 12, the particulate oxidizer 14, the elastomeric binder 16, the particulate dispersant, and other ingredients (if used) in the gas generating composition.

The elastomeric binder 16 and the dispersant 18 are placed on belt 20 and introduced into a hopper 22 in batch form. Hopper valve 24 is opened, which allows the batch mixture of elastomeric binder 16 and dispersant 18 to flow into an azeotrope 28 contained in a mixing tank 30.

The azeotrope 28 is a liquid mixture of two (or more) liquid solvents introduced into the mixing tank 30 from fluid lines 32 and 34. The solvents are selected so that, when combined in mixing tank 30, they behave like a single liquid solvent; namely, the vapor produced by partial evaporation of the liquid mixture azeotrope 28 has the same composition as the liquid mixture azeotrope 28.

The azeotrope 28 of the present invention is preferably a minimum boiling point azeotrope. A minimum boiling point azeotrope exhibits a positive deviation from Raoult's law (i.e., has a vapor pressure greater than either of the solvents that make up the mixture) and has a boiling temperature lower than either of the solvents that make up the azeotrope.

The azeotrope 28 can exist as one liquid phase (homogenous azeotrope) or as two or more phases in equilibrium (heterogeneous azeotrope). The azeotrope 28 may be formed from a mixture of two liquid solvents (binary azeotrope) or three liquid solvents (ternary azeotrope).

The azeotrope 28 comprises at least one solvent that has a solubility parameter $\delta_1$ ($cal^{1/2}cm^{-1/2}$) sufficiently similar to the solubility parameter $\delta_2$ ($cal^{1/2}cm^{-1/2}$) of the elastomeric binder to dissolve the elastomeric binder 16 in the azeotrope 28. Preferably, the difference in the solubility parameters of the one liquid solvent and the elastomeric binder 16 $[\delta_1-\delta_2]$ is less than about 2 ($cal^{1/2}cm^{-1/2}$) More preferably, the difference in the solubility parameter of the one liquid solvent and the elastomeric binder 16 is less than about 1 ($cal^{1/2}cm^{-1/2}$).

The azeotrope 28 further comprises a second solvent that has a polarity effective to dissolve the dispersant 18 in the azeotrope. It is advantageous to utilize a second solvent that is polar because dispersants are typically highly polar materials. Highly polar materials do not readily dissolve in non-polar solvents. Solvents that have a solubility parameter close to the solubility parameter of the elastomeric binder 16 of the present invention are non-polar.

The azeotrope 28 preferably has a boiling point temperature effective to facilitate efficient processing of the gas generating composition by spray drying (to be described). The amount of energy that is required to process the gas generating composition by spray drying is dependent on the boiling point temperature of the azeotrope 28. The higher the boiling point temperature of the azeotrope 28, the greater the amount of energy that is required to heat the azeotrope 28 and evaporate the azeotrope 28 during spray drying. Conversely, a lower boiling point temperature azeotrope 28 requires less energy to heat and evaporate the azeotrope 28 during spray drying.

Preferably, the azeotrope 28 has a boiling point temperature in the range of about 50° C. to about 100° C. An azeotrope with a boiling point temperature below about 50° C. readily evaporates at ambient room temperature (i.e., about 25° C.) making it difficult to process the gas generating composition by spray drying. Azeotropes with a boiling point temperature above about 100° C. require too much energy to process the gas generating composition efficiently. More preferably, the azeotrope 28 has a boiling point temperature between about 70° C. and about 90° C.

A preferred azeotrope 28 is a mixture of two or three hydrocarbon solvents. A more preferred azeotrope 28 is a mixture of about 75% by weight cyclohexane and about 25% by weight dioxane. Cyclohexane has boiling point temperature of about 80.7° C. and a solubility parameter of about 8.2 ($cal^{1/2}cm^{-1/2}$). Dioxane h as a boiling point temperature of about 101.35° C. and a solubility parameter of about 9.9 ($cal^{1/2}cm^{-1/2}$). The azeotrope formed from cyclohexane and dioxane has a boiling point temperature of about 79.5° C.

An azeotrope 28 of cyclohexane and dioxane is preferred because an azeotrope 28 of cyclohexane and dioxane was found to suppress the homo-nucleation of the elastomeric binder 16 during processing the gas generating composition. By homo-nucleation, it is meant the ability of the elastomeric binder 16 while in solution to nucleate and prematurely precipitate out of the solution. If some of the elastomeric binder 16 nucleates and prematurely precipitates out of solution, it is then unavailable for agglomerating the particles of oxidizer and the particles of fuel. This could result in the formation of a gas generating composition comprising a less intimate mixture of particles of fuel and particles of oxidizer.

The amount of azeotrope 28 is that amount effective to dissolve the elastomeric binder 16 and the dispersant 18 and form a viscous solution with the elastomeric binder 16 and the dispersant 18.

The azeotrope 28, the elastomeric binder 16 and the dispersant 18 in the mixing tank 30 are heated by heater 37 and stirred using a high speed mixer 29 until the viscous solution has the consistency of a viscous syrup.

The particles of oxidizer 12 and the particles of fuel 14 are then deposited in batch form onto a belt 36 and introduced into hopper 38. Valve 40 is opened to allow the batch mixture of oxidizer 12 and fuel 14 to be added to the viscous solution of azeotrope 28, elastomeric binder 16, and dispersant 18. Stirring of the viscous solution is continued until the particles of fuel 14 are uniformly dispersed in the viscous solution of azeotrope 28, elastomeric binder 16, and dispersant 18.

The function of the dispersant 18 is to facilitate dispersal of the particles of oxidizer 12 and particles of fuel 14 in the azeotrope 28. The specific viscosity is not critical other than that the solution has to be sprayable. The viscosity of the viscous solution should be sufficiently high to prevent, along with the dispersant, settling of the particles of oxidizer 12 or the particles of fuel 14 from the solution.

The suspension of particulate oxidizer 12, particulate fuel 14, azeotrope 28, elastomeric binder 16 and dispersant 18 is heated by heating element 37 to a temperature below the minimum boiling point temperature of the azeotrope 28. Valve 38 in fluid outlet line 41 of tank 30 is then opened, and the suspension of particulate oxidizer 12, particulate fuel 14, azeotrope 28, elastomeric binder 16 and dispersant 18 is pumped by pump 42 to atomizing means 44 of spray drying apparatus 46.

The atomizing means 44 atomizes the suspension of particulate oxidizer 12, particulate fuel 16, azeotrope 28, elastomeric binder 16 and dispersant 18. The atomizing means 44 can be any atomizing means typically used in spray drying. Examples of atomizing means are high pressure nozzles and high speed rotating disks, both of which are well known in the art.

The atomizing means 44 forms a stream 48 of spheroid droplets of the suspension of particulate oxidizer 12, particulate fuel 16, azeotrope 28, elastomeric binder 16 and dispersant 18. The atomizing means is adjusted to produce spheroid droplets having an average diameter in the range of about 5 $\mu$m to about 150 $\mu$m. More preferably, the spheroid droplets have an average diameter of about 5 $\mu$m to about 100 $\mu$m.

Blower 50 in gas intake line 52 introduces a flow of hot gas into the bottom of the spray drying apparatus 46. The hot gas flows upwardly in apparatus 46 and exits through exhaust opening 54. The stream 48 of spheroid droplets passes counter current to the hot gas flow to the bottom of the apparatus 46 where it is withdrawn, as particles of gas generating composition 62, through valved line 56 into hopper 58 and onto belt 60.

The hot gas in gas intake line 52 is preferably an inert gas, such as nitrogen or argon, or an inert mixture of gases, such as air. The gas is heated by heater 60 to a temperature above the boiling point temperature of the azeotrope 28. The temperature of the hot gas is a temperature that is sufficient to cause evaporation of the azeotrope 28 and drying of the stream 48 of spheroid droplets. Preferably, for an azeotrope having a boiling point temperature in the range of about 50° C. to about 100° C., the temperature of the hot gas is from about from about 80° C. to about 110° C. The temperature of the hot gas is lower than the temperature required when conventional solvents for preparing gas generating compositions, such as toluene, are used as the working fluid for forming the gas generating composition. As a result, less energy is required to heat the hot gas.

As the azeotrope 28 evaporates and the spheroid droplets dry, the particulate oxidizer 12 and the particulate fuel 14 act as nucleation sites for precipitation of the elastomeric binder 16 in the spheroid droplets. The elastomeric binder 16 forms a matrix that agglomerates the individual particles of oxidizer and fuel in each of the droplets.

In a preferred embodiment of the present invention, the particles 62 of gas generating composition so produced are solid spheroid particles comprising an intimate mixture of particles of oxidizer and particles of fuel agglomerated with the elastomeric binder. The average diameters of the spheroid particles of gas generating composition are from about 5 $\mu$m to about 100 $\mu$m. More preferably, the average diameters of the spheroid particles of the gas generating composition are from about 5 $\mu$m to about 50 $\mu$m.

Preferably, measured amounts of the spheroid agglomerate particles of gas generating composition are pressed into shapes suitable for use in a vehicle occupant protection apparatus. Preferred shapes are cylindrical pellets that have an average diameter of about 0.5 inch and a length of about 3 inches or tablets that have a shape and size similar to a BAYER aspirin tablet.

The hot gas that exits exhaust opening 54 carries the evaporated azeotrope through gas line 64 to a condenser 66. The hot gas and evaporated azeotrope are cooled in the condenser 66 to a temperature below the boiling point of the azeotrope 28. As the temperature of the hot gas and azeotrope 28 decreases, the azeotrope 28 condenses into a liquid. The condensed liquid azeotrope flows to the bottom of the condenser 66 where it collected and withdrawn as a fluid through valved line 68. The condensed azeotrope is stored in a storage tank (not shown) until it is reused for additional processing of gas generating compositions.

The process of the present invention is particularly useful in the preparation of a gas generating composition suitable for inflating a vehicle occupant protection device, such as illustrated schematically in FIG. 2.

Referring to FIG. 2, an apparatus 110 comprises an inflator 114. The inflator 114 contains the gas generating composition 62. The gas generating composition 62 is ignited by an igniter 118 operatively associated with the gas generating composition 62. Electric leads 119 convey current to the igniter 118 as part of an electric circuit that includes a sensor (not shown) responsive to vehicle deceleration above a predetermined threshold. The apparatus 110 also comprises a vehicle occupant protection device 120. A gas flow means 122 conveys gas, which is generated by combustion of the gas generating composition 62 in the inflator 114, to the vehicle occupant protection device 120.

A preferred vehicle occupant protection device 120 is an air bag, which is inflatable to protect a vehicle occupant in the event of a collision. Other vehicle occupant protection devices that can be used in the present invention are inflatable seat belts, inflatable knee bolsters, inflatable air bags to operate knee bolsters, inflatable head liners, and/or inflatable side curtains.

The gas generating composition 62 as indicated above comprises an intimate mixture of an oxidizer, a fuel, an elastomeric binder, and a dispersant.

The oxidizer of the gas generating composition 62 can be any oxidizer commonly used in a gas generating composition for inflating a vehicle occupant protection device. A preferred oxidizer is an inorganic salt oxidizer. Examples of inorganic salt oxidizers that can be used in a gas generating composition for inflating a vehicle occupant protection device are alkali metal nitrates such as sodium nitrate and potassium nitrate, alkaline earth metal nitrates such as strontium nitrate and barium nitrate, alkali metal perchlorates such as sodium perchlorate, potassium perchlorate, and lithium perchlorate, alkaline earth metal perchlorates, ammonium perchlorate, ammonium nitrate, and mixtures thereof.

A preferred inorganic salt oxidizer is ammonium nitrate. Ammonium nitrate is preferred because it produces upon combustion a gas product essentially free of smoke and toxic gases.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces upon combustion hydrogen chloride. Non-halogen alkali metal or alkaline earth metal salts react with hydrogen chloride produced upon combustion to form alkali metal or alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

The oxidizer is incorporated in the gas generating composition in the form of particles. The average particle size of the oxidizer is from about 1 $\mu$m to about 100 $\mu$m. Preferably the average particle size of the oxidizer is from about 1 $\mu$m to about 20 $\mu$m. Small particle sizes in the range of about 1 $\mu$m to about 100 $\mu$m for the oxidizer provide optimum nucleation sites for precipitation of the binder in the spray drying step.

The amount of oxidizer in the gas generating composition is that amount necessary to achieve sustained combustion of the gas generating composition. The amount of inorganic salt oxidizer necessary to achieve sustained combustion of the gas generating composition is from about 30% to about 90% by weight of the gas generating composition. A preferred amount of inorganic salt oxidizer is that amount necessary to oxygen balance the gas generating composition and produce, upon combustion with the water soluble binder and the supplemental fuel, a combustion product that is substantially free of carbon monoxide. By substantially free of carbon monoxide, it is meant that the volume of carbon monoxide is less than about 4% by volume of gas produced upon combustion. A preferred amount of oxidizer is from about 40% to about 80% by weight of the gas generating composition.

The fuel of the gas generating composition 62 can be any non-azide nitrogen containing organic fuel commonly used in a gas generating composition for inflating a vehicle occupant protection device. In a preferred embodiment of the present invention, the fuel is a nitramine. Preferred nitramines are selected from the group consisting of cyclotrimethylenetrinitramine (RDX), cyclotetramethylenetetranitramine (HMX), and mixtures of cyclotetramethylenetetranitramine and cyclotrimethylenetrinitramine.

It is advantageous to use cyclotetramethylenetetranitramine and cyclotrimethylenetrinitramine as fuels in combination with ammonium nitrate because cyclotrimethylenetrinitramine and cyclotetramethylenetetranitramine lack amine functionality groups. Ammonium nitrate in storage at elevated temperatures (i.e., about 120° C.) sublimates to form ammonium ($NH_3$) and nitric acid ($HNO_3$). Some non-azide fuels, which are commonly used for inflating inflatable vehicle occupant protection devices, form salts with ammonium nitrate in the presence of nitric acid. The resulting salts formed from fuels with amine functionality groups and ammonium nitrate have reduced thermal stability and a greater tendency to decompose over time or in storage.

The non-azide nitrogen containing organic fuel can also be other nitrogen containing organic fuels typically used in a gas generating composition including: cyanamides such as dicyanamide and salts of cyanamides; tetrazoles such as 5-aminotetrazole and derivatives and salts of tetrazoles; carbonamides such as azo-bis-dicarbonamide and salts of carbonamide; triazoles such as 3-nitro-1,2,4-triazole-5-one (NTO) and salts of triazoles; guanidine and other derivatives of guanidine such as nitroguanidine (NQ) and other salts of guanidine and guanidine derivatives; tetramethyl ammonium nitrate; urea and salts of urea; and mixtures thereof.

The fuel is incorporated in the gas generating composition in the form of particles. The average particle size of the fuel is from about 1 $\mu$m to about 100 $\mu$m. Preferably, the average particle size of the fuel is from about 1 $\mu$m to about 20 $\mu$m.

The amount of fuel in the gas generating composition is that amount necessary to achieve sustained combustion of the gas generating composition. The amount can vary depending upon the particular fuel involved and other reactants. A preferred amount of fuel is in the range of about 10% to about 70% by weight of the gas generating composition. More preferably, the amount of fuel in the gas generating composition is from about 30% to about 60% by weight of the gas generating composition.

Preferably, the elastomeric binder of the gas generating composition 62 is non-energetic. Suitable non-energetic elastomeric are well known in the art. Preferred elastomeric binders are cellulose based binders such as cellulose acetate butyrate (CAB), polycarbonates, polyurethanes, polyesters, polyethers, polysuccinates, thermoplastic rubbers, polybutadiene, polystyrene, and mixtures thereof. A more preferred elastomeric binder is "KRATON", a polyethylene/butylene-polystyrene block copolymer manufactured by Shell Chemical Company.

A preferred amount of binder is from about 1% to about 15% by weight of the gas generating composition. More preferably, the amount of binder is from about 2.5% to about 10% by weight of the gas generating composition.

The dispersant of the gas generating composition 62 is any substance that reduces the interfacial surface tension of the particles of oxidizer and the particles of fuel and promotes a uniform and maximum separation of the particles of oxidizer and the particles of fuel during preparation of the gas generating composition. Examples of dispersants are amides of carboxylates such as amide isotearate, polyvinyl pyrrolidone copolymers, and metal carboxylates. A preferred dispersant is GANEX, a polyvinyl pyrrolidone commercially available from GAF Corporation.

The amount of dispersant is that amount sufficient to reduce the interfacial surface tension of the particles of oxidizer and the particles of fuel and promote the maximum separation of the particles of oxidizer and the particles of fuel during preparation of the gas generating composition according to the process of FIG. 1. A preferred amount of dispersant is from about 0.01% to about 5% by weight of the gas generating composition.

The gas generating composition may further comprise other ingredients commonly added to a gas generating composition for a vehicle occupant protection apparatus. Such ingredients include other oxidants, plasticizers, process aids, burn rate modifiers, and ignition aids, all in relatively small amounts.

EXAMPLE

A gas generating composition was prepared by adding to a mixing tank containing a Silverson high shear mixer MODEL DX (manufactured by Silverson Machines Inc.) 10 grams of KRATON elastomeric binder (commercially available from Shell Chemical Company), 1 gram Ganex dispersant (commercially available from GAF Corporation) and 400 cc of an azeotrope of about 75.4% by weight cyclohexane and about 24.6% by weight dioxane. Cyclohexane has a boiling point temperature of 80.7° C. and a solubility parameter of 8.2 ($cal^{1/2}cm^{-1/2}$). Dioxane has a boiling point temperature of 101.35° C. and a solubility parameter of 9.9 ($cal^{1/2}cm^{-1/2}$). The azeotrope formed from cyclohexane and dioxane has a boiling point of 79.5° C. The Kraton has a solubility parameter of about 8.5 ($cal^{1/2}cm^{-1/2}$).

The mixture of Kraton, Ganex, and azeotrope were heated to a temperature in the range of about 60° C. to about 70° C. and stirred until the Kraton and the Ganex dissolved in the azeotrope. About 65 grams of ammonium nitrate and about 25 grams of cyclotrimethylenetrinitramine (RDX), were then added to the Kraton, Ganex and azeotrope solution. The average particle size of the ammonium nitrate was about 5 $\mu$m, and the average particle size of the cyclotrimethylenetrinitramine was about 10 $\mu$m. The particles of ammonium nitrate, the particles of cyclotrimethylenetrinitramine, and the Kraton, Ganex and azeotrope solution were stirred until a suspension was formed having a viscosity high enough to prevent settling of the particles of ammonium nitrate and cyclotrimethylenetrinitramine.

The viscous suspension was heated to a temperature of about 70° C. and pumped into a spray dryer (Niro Minospray dryer, manufactured by Niro Inc., Columbia, Md.). The viscous suspension was atomized by spraying the viscous suspension through a fluid nozzle to form a stream of spheroid droplets having an average diameter ranging from about 10 $\mu$m to about 100 $\mu$m. The droplets were passed through a counter-current of hot air, which had a temperature of about 110° C. The hot air caused evaporation of the azeotrope from the droplets as well as the precipitation of the Kraton around the particles of ammonium nitrate and cyclotrimethylenetrinitramine.

Spheroid particles of the gas generating composition were formed as a result of the spray drying process. The spheroid particles of gas generating composition comprised particles of the ammonium nitrate and the cyclotrimethylenetrinitramine agglomerated with the Kraton. The spheroid particles had an average particle diameter of about 25 $\mu$m. The spheroid particles were neither brittle at −40° C. nor capable of losing their shape or configuration at 90° C.

Predetermined amounts of the particulate gas generating material were compacted under a compaction pressure of about 11,000 ft-lb (1521 kg-m) into cylindrical pellets having a diameter of about 0.5 inch and a length of about 3 inches.

Advantages of the present invention should now be apparent. Primarily, the present invention takes advantage of the favorable processing characteristics of using an azeotrope during the preparation of a gas generating composition comprising an elastomeric binder, a dispersant, a particulate oxidizer, and a particulate fuel. The use of an azeotrope in the process of the present invention offers improved solubility of the elastomeric binder and the dispersant. Improved solubility of both the elastomeric binder and the dispersant allows for the formation of a particulate gas generating composition comprising an intimate mixture of a particulate oxidizer and a particulate fuel. This, in turn, provides a more predictable burn rate of the gas generating composition, which is important for a vehicle occupant protection apparatus. Moreover, by using an azeotrope in the process of the present invention, the boiling point temperature is less than it would be using traditional solvents such as toluene. This results in a lower cost of product because less energy in the form of heat is required to spray dry the gas generating composition. Further, the azeotrope can be easily recycled and reused in subsequent spray drying processes because the evaporated azeotrope has the same composition as the azeotrope originally used to dissolve the elastomeric binder and the dispersant. Additionally, an azeotrope comprising cyclohexane and dioxane suppresses homo-nucleation of the elastomeric binder during processing of the gas generating composition, which, in turn, enhances the formation of a gas generating composition comprising a more intimate mixture of particulate fuel and particulate oxidizer.

From the above description of the invention, those skilled in the art will perceive improvements, changes and modifications. Such improvements, changes and modifications within the skill of the art are intended to be covered by the appended claims.

Having described the invention, the following is claimed:

1. A process for preparing a gas generating composition for a vehicle occupant protection apparatus comprising the following steps:

obtaining desired quantities of ingredients of the gas generating composition measured in predetermined amounts according to the percentage of the ingredients in the gas generating composition, the ingredients including an elastomeric binder, a fuel, and an oxidizer;

mixing the ingredients with an azeotrope to form a suspension;

atomizing the suspension to form a stream of spheroid droplets; and contacting the spheroid droplets with gas to remove the azeotrope from said spray droplets and produce solid spheroid particles of the gas generating composition in which the oxidizer and fuel particles are intimately mixed with each other and bound together by the elastomeric binder.

2. The process of claim 1 wherein gas generating composition further includes a dispersant.

3. The process of claim 2 wherein the azeotrope comprises at least two solvents, one of said solvents having a solubility parameter effective to dissolve the elastomeric binder in the azeotrope, and the other of said solvents having a polarity effective to dissolve the dispersant in the suspension.

4. The process of claim 1 wherein the azeotrope has boiling point temperature from about 50° C. to about 100° C.

5. The process of claim 4 wherein the azeotrope has a boiling point temperature from about 70° C. to about 100° C.

6. The process of claim 1 wherein the azeotrope is a minimum boiling point azeotrope.

7. The process of claim 3 wherein the difference in the solubility parameters of the one liquid solvent and the elastomeric binder $[\delta_1-\delta_2]$ is less than about 2 ($cal^{1/2}cm^{-1/2}$).

8. The process of claim 7 wherein the azeotrope is a mixture of about 75% by weight cyclohexane and about 24% by weight dioxane.

9. The process of claim 1 wherein the oxidizer is an inorganic salt oxidizer selected from the group consisting of alkali metal nitrates, alkaline earth metal nitrates, alkali metal perchlorates, alkaline earth metal perchlorates, ammonium perchlorate, ammonium nitrate, and mixtures thereof.

10. The process of claim 9 wherein the inorganic salt is ammonium nitrate.

11. The process of claim 1 wherein the fuel is a non-azide organic fuel selected from the group consisting of cyclotrimethylenetrinitramine (RDX), cyclotetramethylenetetranitramine (HMX), and mixtures of cyclotetramethylenetetranitramine and cyclotrimethylenetrinitramine.

12. The process of claim 1 wherein the binder is selected from the group consisting of cellulose acetate butyrate (CAB), polycarbonates, polyurethanes, polyesters, polyethers, polysuccinates, thermoplastic rubbers, polybutadiene, polystyrene, and mixtures thereof.

13. The process of claim 2 wherein the dispersant is a polar dispersant.

14. The process of claim 13 wherein the dispersant is polyvinyl pyrrolidone.

15. A process for preparing a gas generating composition for a vehicle occupant protection apparatus comprising the following steps:

obtaining desired quantities of ingredients of the gas generating composition measured in predetermined amounts according to the percentage of the ingredients in the gas generating composition, the ingredients including an oxidizer, a fuel, an elastomeric binder and a dispersant;

mixing the ingredients with an azeotrope to form a suspension, the azeotrope comprising at least two solvents, wherein one of the solvents has a solubility parameter effective to dissolve the elastomeric binder in the azeotrope and the other of the solvents has a polarity effective to dissolve the dispersant in the azeotrope;

atomizing the suspension to form a stream of spheroid droplets; and contacting the spheroid droplets with gas to remove the azeotrope from said spray droplets and produce solid spheroid particles of the gas generating composition in which the oxidizer and fuel particles are intimately mixed with each other and bound together by the elastomeric binder.

16. The process of claim 15 wherein the azeotrope has boiling point temperature from about 50° C. to about 100° C.

17. The process of claim 16 wherein the azeotrope has a boiling point temperature from about 70° C. to about 100° C.

18. The process of claim 15 wherein the azeotrope is a minimum boiling point azeotrope.

19. The process of claim 15 wherein the difference in the solubility parameters of the one liquid solvent and the elastomeric binder $[\delta_1-\delta_2]$ is less than about 2 ($cal^{1/2}cm^{-1/2}$).

20. The process of claim 15 wherein the azeotrope is a mixture of about 75.4% by weight cyclohexane and about 24.6% by weight dioxane.

21. The process of claim 15 wherein the oxidizer is an inorganic salt oxidizer selected from the group consisting of alkali metal nitrates, alkaline earth metal nitrates, alkali metal perchlorates, alkaline earth metal perchlorates, ammonium perchlorate, ammonium nitrate, and mixtures thereof.

22. The process of claim 21 wherein the inorganic salt is ammonium nitrate.

23. The process of claim 15 wherein the fuel is a non-azide organic fuel selected from the group consisting of cyclotrimethylenetrinitramine (RDX), cyclotetramethylenetetranitramine (HMX), and mixtures of cyclotetramethylenetetranitramine and cyclotrimethylenetrinitramine.

24. The process of claim 15 wherein the binder is selected from the group consisting of cellulose acetate butyrate (CAB), polycarbonates, polyurethanes, polyesters, polyethers, polysuccinates, thermoplastic rubbers, polybutadiene, polystyrene, and mixtures thereof.

25. The process of claim 15 wherein the dispersant is a polar dispersant.

26. The process of claim 25 wherein the dispersant is polyvinyl pyrrolidone.

* * * * *